US011905728B2

(12) United States Patent
Pugliese et al.

(10) Patent No.: US 11,905,728 B2
(45) Date of Patent: Feb. 20, 2024

(54) METHOD AND SYSTEM FOR PROVIDING A MULTI-WEIR DOOR ASSEMBLY FOR USE IN SKIMMING SYSTEMS THAT USE MULTI-SPEED PUMPS

(71) Applicant: Custom Molded Products, LLC, Newnan, GA (US)

(72) Inventors: Angelo V. Pugliese, Palm Bay, FL (US); Zachary T. Vogtner, Fayetteville, GA (US)

(73) Assignee: Custom Molded Products, LLC, Newnan, GA (US)

( * ) Notice: Subject to any disclaimer, the term of this patent is extended or adjusted under 35 U.S.C. 154(b) by 120 days.

(21) Appl. No.: 17/747,275

(22) Filed: May 18, 2022

(65) Prior Publication Data

US 2022/0372781 A1 Nov. 24, 2022

Related U.S. Application Data

(60) Provisional application No. 63/189,744, filed on May 18, 2021.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 4/512
See application file for complete search history.

(56) References Cited

U.S. PATENT DOCUMENTS 3,314,543 A * 4/1967 Nash ..... E04H 4/1272 405/101
4,608,167 A * 8/1986 Raubenheimer ..... E04H 4/1227 210/242.1
6,453,483 B1 * 9/2002 Jacuzzi ..... E04H 4/1272 405/101

* cited by examiner

*Primary Examiner* — Christine J Skubinna
(74) *Attorney, Agent, or Firm* — Laurence P. Colton; Smith Tempel Blaha LLC

(57) ABSTRACT

A multi-weir door assembly is coupled to a skimmer body near a front entrance of the skimmer body such that a flow of water received in the front entrance is incident on a front side of the multi-weir door assembly. The multi-weir door assembly comprises multiple weir doors that are rotationally coupled to the skimmer body by at least a first hinge assembly. Each of the weir doors has a respective buoyancy, and at least first and second weir doors of the multiple weir doors have first and second buoyancies that are different from one another such that the flow of water incident on the multi-weir door assembly affects the first and second weir doors differently in terms of an angular degree to which the incident flow of water causes the first and second weir doors to rotate about first and second axes of rotation, respectively.

20 Claims, 10 Drawing Sheets

METHOD AND SYSTEM FOR PROVIDING A MULTI-WEIR DOOR ASSEMBLY FOR USE IN SKIMMING SYSTEMS THAT USE MULTI-SPEED PUMPS

CROSS-REFERENCE TO RELATED APPLICATIONS

This application is a nonprovisional application that claims priority to, and the benefit of the filing date of, U.S. provisional application No. 63/189,744, filed on May 18, 2021, entitled "A METHOD AND SYSTEM FOR PROVIDING A DUAL WEIR DOOR FOR SKIMMERS USING MULTI-SPEED PUMPS", which is incorporated by reference herein in its entirety.

BACKGROUND OF THE INVENTION

Technical Field

The present invention generally is in the field of skimming devices and methods for skimming spas, swimming pools, hot tubs, garden baths, and the like. The present invention more particularly is in the field of multi-weir door assemblies for skimmers and methods for skimming using multi-weir door assemblies for spas, swimming pools, hot tubs, garden baths, and the like.

Prior Art

Many existing spas, swimming pools, hot tubs, garden baths, and the like include some type of skimmer. Skimmers are designed to remove surface debris from spas, pools, hot tubs, garden baths, and the like.

This removal of debris is accomplished by directing the flow of the water in a broad thin layer across the top of a floating weir door that is at the entrance or mouth of the skimmer. In doing so, the surface velocity increases drawing in the debris floating past the skimmer mouth and the floating weir door. The skimmer is connected to a pump via piping (typically rigid PVC plumbing) and water is drawn into the skimmer via the pump.

Prior art skimmers are often designed to operate most efficiently at the full flow of the pool pump, which usually has one speed of operation. With recently mandated energy conservation initiatives, pools are being equipped with two speed, multi-speed, or variable speed pumps. In efforts to use less energy, the pool pumps are designed to operate at much lower flow rates than was typical in the past. When these pumps are operated as required by the energy efficiency standards, there often is not enough water flow over the floating weir door to provide sufficient velocity for debris to flow over and past the floating weir door.

Several skimmer manufacturers have incorporated venturis in an attempt to increase flow over the skimmer weir door while the pump is in low speed. In a venturi skimmer, an additional water path from the pump is introduced across the lower interior chamber of the skimmer directing flow generally perpendicular to the water flowing through the skimmer and then out back to the pool. The additional venturi water path has a nozzle inside the skimmer to create a pressure drop (venturi effect) which increases the flow of water through the skimmer.

One problem with these prior art systems is that the venturi requires high velocity to create the added flow. The prior art systems work well when the pump is on high speed, but they do not work well if at all when the pump is on low speed, which is when the skimmer needs the additional flow.

There is, accordingly, a need for new and improved skimmers that operate efficiently when pumps are on low speeds and methods for skimming spas, swimming pools, hot tubs, garden baths, and the like, that allow debris to flow over and move past weir doors of the skimmer. There also is a need for improved skimming features and methods for skimming artificial bodies of water and the like which may use pumps operating at low speeds. It is to these needs and others that the present invention is directed.

BRIEF SUMMARY OF THE INVENTION

A skimming system and method for skimming artificial bodies are disclosed herein. The skimming system comprises a skimmer body and a multi-weir door assembly. The skimmer body is configured to be installed in an artificial body of water and has a front entrance for receiving a flow of water of the artificial body of water into an interior of the skimmer body. The multi-weir door assembly is mechanically coupled to the skimmer body near the front entrance such that the flow of water received in the front entrance is incident on a front side of the multi-weir door assembly. The multi-weir door assembly comprises multiple weir doors that are rotationally coupled to the skimmer body by at least a first hinge assembly. Each of the weir doors has a respective buoyancy, and at least first and second weir doors of the multiple weir doors have first and second buoyancies that are different from one another such that the flow of water incident on the multi-weir door assembly affects the first and second weir doors differently in terms of an angular degree to which the incident flow of water causes the first and second weir doors to rotate about first and second axes of rotation, respectively.

The method comprises:

receiving a flow of water of an artificial body of water into an interior of a skimmer body of a skimming system through a front entrance of the skimmer body, wherein the skimmer body is installed in the artificial body of water and the multi-weir door assembly is mechanically coupled to the skimmer body near the front entrance such that the flow of water received in the front entrance is incident on a front side of the multi-weir door assembly; and performing skimming with the multi-weir door assembly; the multi-weir door assembly comprising multiple weir doors that are rotationally coupled to the skimmer body by at least a first hinge assembly; each of the weir doors having a respective buoyancy, and at least first and second weir doors of the multiple weir doors having first and second buoyancies that are different from one another such that the flow of water incident on the multi-weir door assembly affects the first and second weir doors differently in terms of an angular degree to which the incident flow of water causes the first and second weir doors to rotate about first and second axes of rotation, respectively.

A complete understanding of the present invention may be obtained by reference to the accompanying drawings, when considered in conjunction with the detailed description of preferred embodiments, in which like elements and components bear the same designations and numbering throughout the figures.

BRIEF DESCRIPTION OF THE DRAWINGS

In the drawings, like reference numerals refer to like parts throughout the various views unless otherwise indicated. For reference numerals with letter character designations such as "102*a*" or "102*b*", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF PREFERRED EMBODIMENTS

Figure 1:
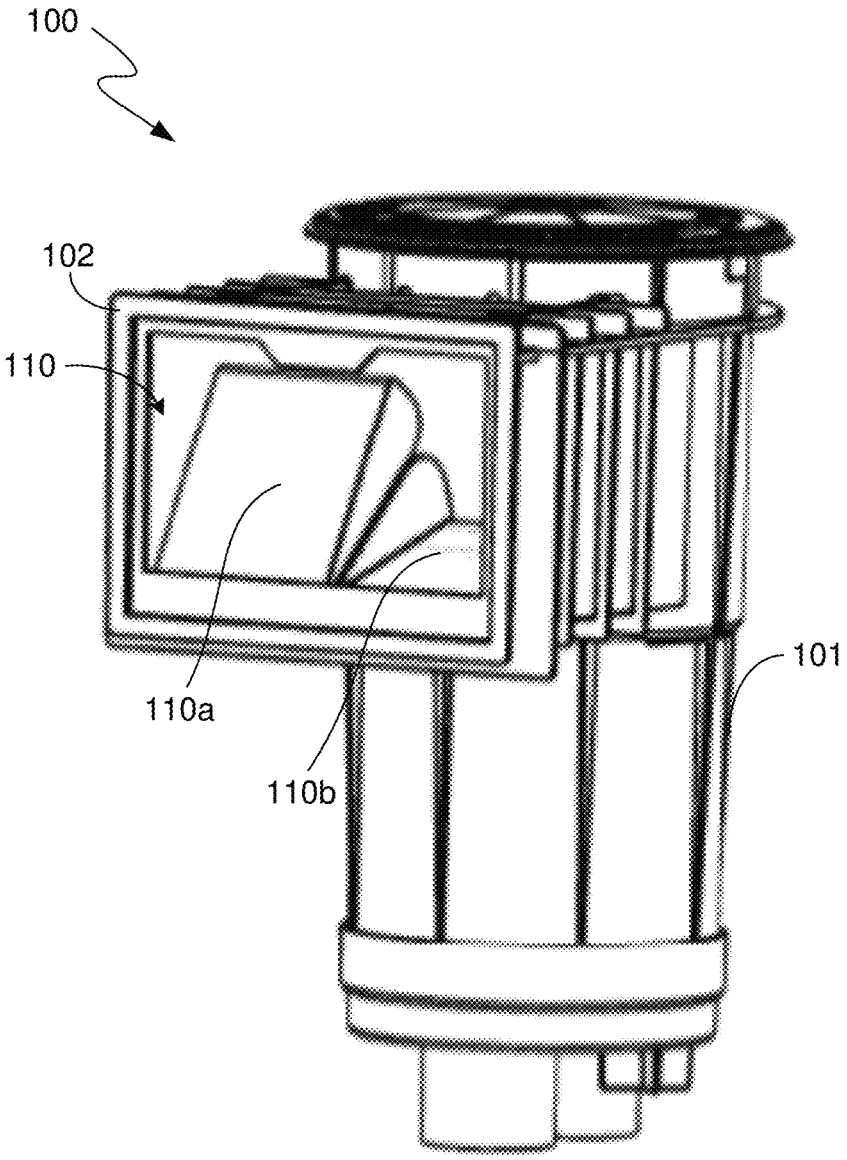
FIG. 1 illustrates a perspective view of a skimming system that incorporates a multi-weir door assembly according to one exemplary embodiment in which the multi-weir door assembly is a dual weir door assembly.

Embodiments and aspects of the present invention provide improved devices and methods for skimming spas, swimming pools, hot tubs, garden baths, and the like, that are not susceptible to the limitations and deficiencies of the prior art. The inventive concepts and principles described herein, in certain non-limiting embodiments, allow for fluid flow across at least two weir doors having different flotation/buoyancy.

The terminology used herein is for purposes of describing particular embodiments only and is not intended to be limiting. Any specifically-defined terms are in addition to the technical, scientific, or ordinary meanings of the defined terms as commonly understood and accepted in the relevant context.

The word "exemplary" is used herein to mean "serving as an example, instance, or illustration." Any aspect described herein as "exemplary" is not necessarily to be construed as exclusive, preferred or advantageous over other aspects.

The terms "a," "an" and "the" include both singular and plural referents, unless the context clearly dictates otherwise. Thus, for example, "a device" includes one device and plural devices.

The terms "substantial" or "substantially" mean to within acceptable limits or degrees acceptable to those of skill in the art. For example, the term "substantially parallel to" means that a structure or device may not be made perfectly parallel to some other structure or device due to tolerances or imperfections in the process by which the structures or devices are made or installed.

Relative terms, such as "over," "above," "below," "top," "bottom," "front," "back," "rear", "upper" and "lower" may be used to describe the various elements' relationships to one another, as illustrated in the accompanying drawings. These relative terms are intended to encompass different orientations of the device and/or elements in addition to the orientation depicted in the drawings. For example, if the device were inverted with respect to the view in the drawings, an element described as "above" another element, for example, would now be below that element.

With the above context in mind, a first exemplary embodiment of the inventive concepts provides an efficient, effective, and versatile skimming system for a pool or spa, wherein the system comprises multiple weir doors that allow fluid to flow across one or more of the doors during low fluid flows, medium fluid flows and high fluid flows produced by a variable speed fluid pump system.

In one exemplary embodiment, the weir doors may be substantially the same size, but in alternate embodiments, the weir doors can be of different sizes to achieve certain desired results. Further, in a first exemplary embodiment, the weir doors may share a single axis of rotation, but in alternate embodiments, each door may have its own axis of rotation.

In certain applications, it may be optimal or desirable for a first, more buoyant weir door to be larger (wider) than a second, less buoyant weir door. Alternatively, in other exemplary embodiments, it may be optimal for the second, less buoyant weir door to be larger (wider) than the first, more buoyant weir door.

A wider high-buoyancy door may be appropriate for supporting a high end of the flow/velocity range. Meanwhile, a wider low-buoyancy door may be appropriate for supporting a low end of that flow/velocity range. Various configurations are possible and are dependent on pump specifications (i.e., variable fluid flow rates achieved with the pump system).

As will be understood by one of ordinary skill in the art, weir door performance may be tailored/designed for specific pumps having different operating ranges. That is, it is understood by one of ordinary skill in the art that even among variable speed pumps, there can be varying flow ranges (i.e., one-horsepower variable speed pump flow rates compared to a three-horsepower variable speed pump flow rates, etc.).

Referring now to the drawings, which are for purposes of illustrating the various embodiments of the present invention only and not for purposes of limiting the scope of the present disclosure, FIG. 1 illustrates a perspective view of a skimming system 100 according to one exemplary embodiment. The skimming system 100 may include a skimmer body 101, a face plate 102 to a pool or spa side entrance to the skimmer body 101, and a dual weir door assembly 110 comprising a high buoyancy weir door 110*a* and a low buoyancy weir door 110*b*.

According to this exemplary embodiment, each weir door 110*a*, 110*b* may have substantially the same width and height dimension. The doors 110*a*, 110*b* also may share a single or common rotation axis. However, as will be described below in more detail, the dual weir door assembly 110 may have a variety of configurations, dimensions and coupling arrangements, and the weir doors 110*a*, 110*b* may have different axes of rotation. The skimmer body 101 may also have a variety of configurations.

Figure 2:
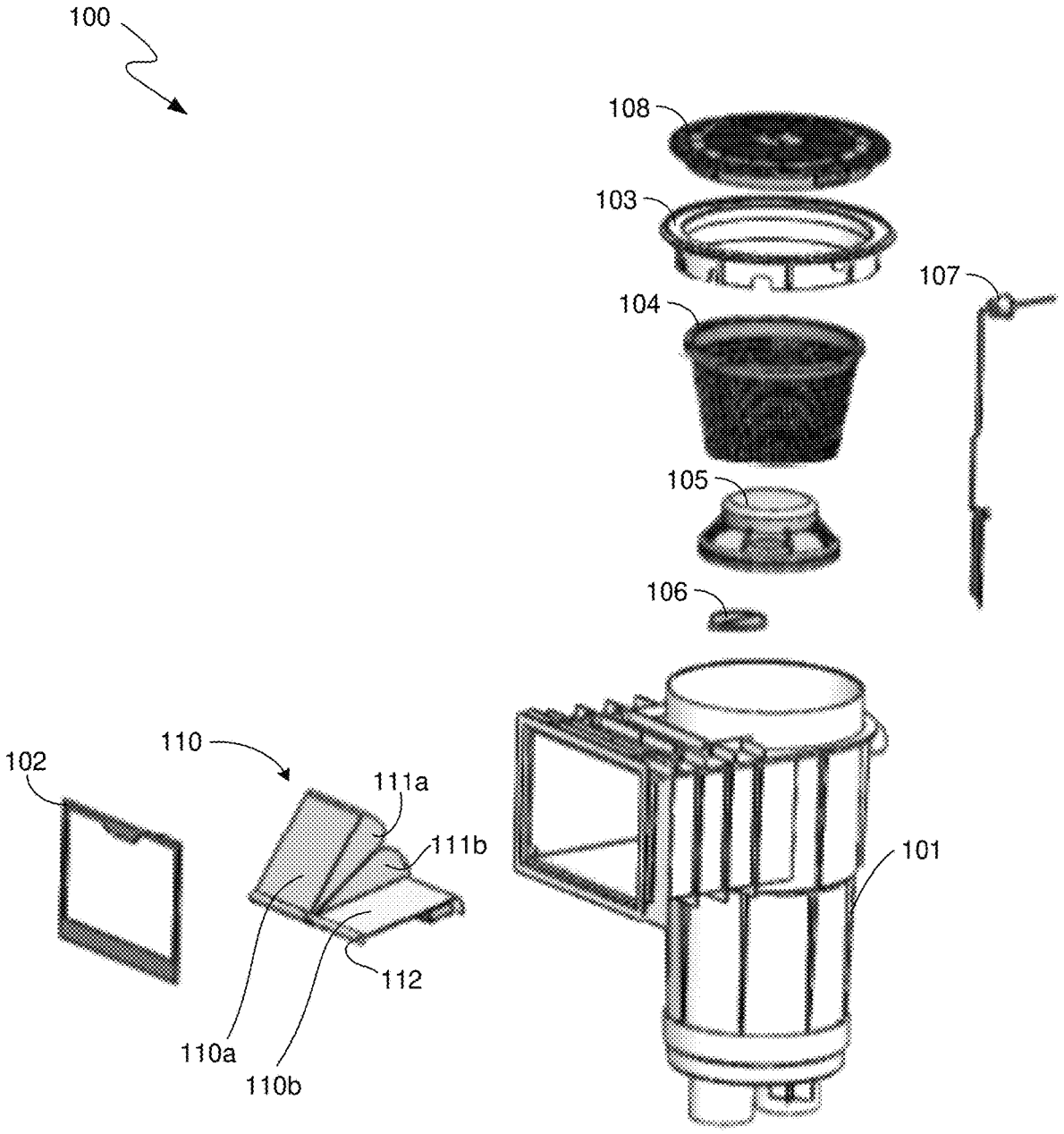
FIG. 2 illustrates an exploded, perspective view of the skimming system illustrated in FIG. 1.

Referring now to FIG. 2, this figure illustrates an exploded or assembly view of the skimming system 100 illustrated in FIG. 1 in accordance with an exemplary embodiment. In FIG. 2, further details of the dual weir doors 110*a*, 110*b* are visible. The first weir door 110*a* with the higher buoyancy is shown with a first fin 111*a*. The second weir door 110*b* with the lower buoyancy is shown with a second fin 111*b*.

As noted previously, these fins 111*a*, 111*b* block a gap between the two weir doors 110*a*, 110*b* that would exist in the absence of the fins 111*a*, 111*b* when the doors are at different angles of rotation relative to a common axis of a hinge assembly 112. Blocking this gap prevents water bypass across the working range of fluid flows and fluid levels between the two weir doors 110*a*, 110*b*. The fins 111*a*, 111*b* may be of any shape or size so long as the gap between the two weir doors 110*a*, 110*b* is sufficiently blocked to prevent (significant) water bypass between the two weir doors 110*a*, 110*b* when one weir door 110*a* is raised while the other weir door 110*b* is lowered because of the different buoyancies of the weir doors 110*a*, 110*b*.

The remaining components of the skimming system 100 shown in FIG. 2 are common components to known skimming systems, such as, but not limited to, a skimmer faceplate 102, a skimmer collar 103, a filter basket 104, a float valve 105, a diverter plate 106, a water bonding assembly 107, and a round skimmer lid 108. As will be understood by persons of skill in the art in view of the present disclosure, the skimming system 100 is not limited to including these common components having the particular configurations depicted in FIG. 2, as skimming systems vary among manufacturers and skimming system technology can change over time. Thus, one or more of these common components can be replaced, eliminated and/or changed in design or configuration.

The skimming system 100 shown in FIG. 2 is intended for installation in a concrete/gunite pool. However, it is possible to employ additional and/or alternate components to allow for installation in a vinyl liner or fiberglass pool (face plate, screws, gaskets, throat extension, wide-mouth extensions, etc.) as understood by one of ordinary skill in the art.

Figure 3:
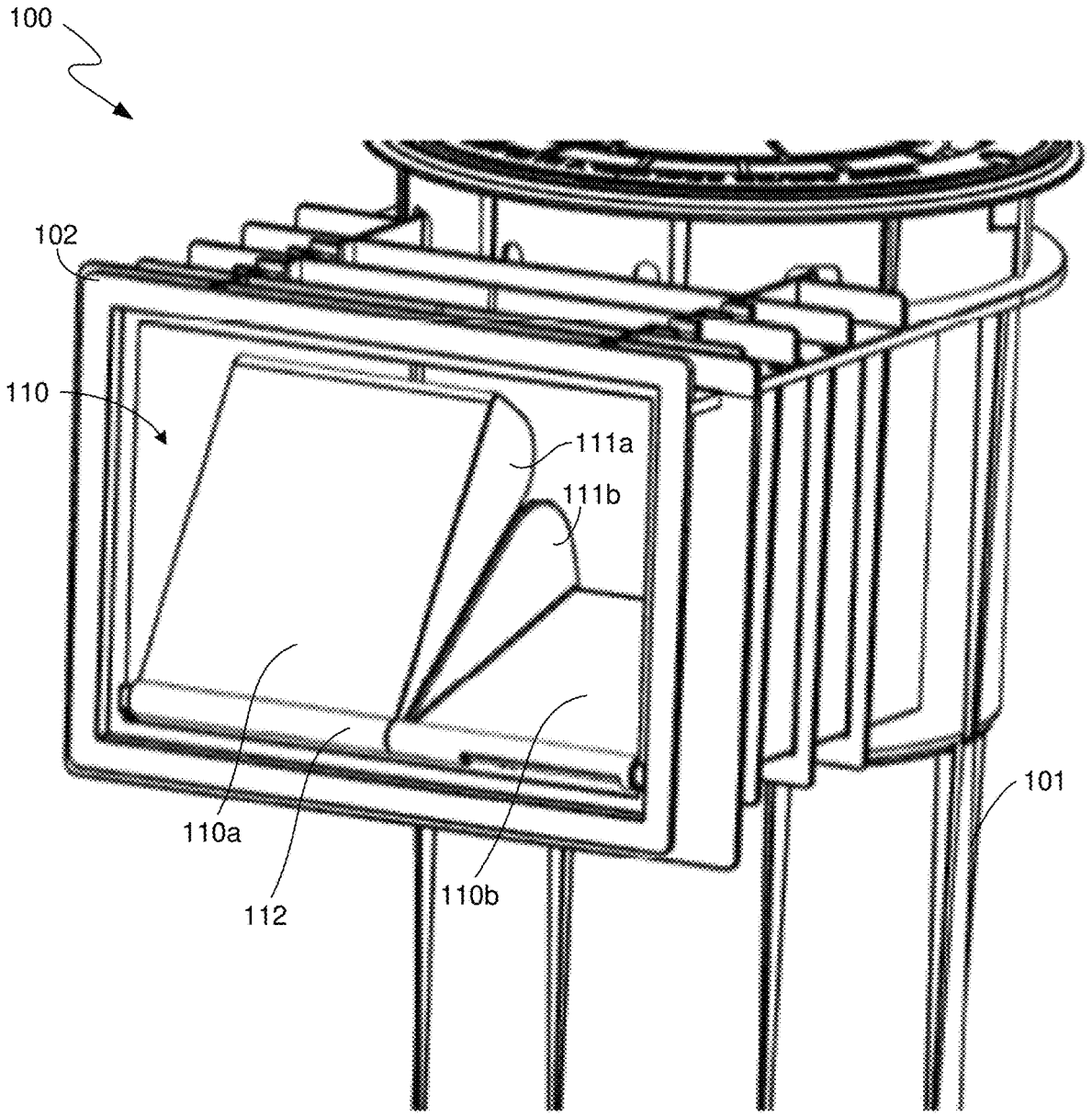
FIG. 3 illustrates an enlarged perspective view of a front entrance portion of the skimming system shown in FIGS. 1 and 2 illustrating further details of the dual weir door assembly.

Referring now to FIG. 3, this figure is an enlarged front view of a front entrance portion of the skimming system 100 shown in FIG. 1 illustrating further details of the two weir doors 110*a*, 110*b*. In FIG. 3, the skimmer faceplate 102 is not shown in order to view the hinge assembly 112 that rotationally couples the weir doors 110*a*, 110*b* to the front entrance of the skimmer body 101. In addition to serving as an aesthetic covering for the skimming system 100, the faceplate 102 (FIG. 1) assists in holding the weir doors 110*a*, 110*b* in place and preventing the doors 110*a*, 110*b* from rotating forward beyond the faceplate 102. An exemplary embodiment of the hinge assembly 112 is described below in more detail with reference to FIG. 4C.

With reference again to FIG. 3, the first weir door 110*a* is the higher buoyancy door and is shown in a higher, i.e., more closed, position to prevent the door 110*a* from performing skimming. The second weir door 110*b* is the lower buoyancy door and is shown in FIG. 3 in a lower, i.e., more open, position to allow it to perform skimming. Generally, the positioning of the weir doors 110*a*, 110*b* shown in FIG. 3 occurs during a lower water flow, where the first weir door 110*a* is not affected, or is at least less affected, by the lower water flow due to the higher buoyancy of the first weir door 110*a*. With this positioning, the second weir door 110*b* is more affected by the lower water flow due to the lower buoyancy of the second weir door 110*b*, and thus is in a position that allows skimming to occur. With a higher water flow, both weir doors 110*a*, 110*b* will be affected by the higher water flow, and therefore the first weir door 110*a* would also be in a lower, i.e., more open, position similar to the position shown for the second weir door 110*b* such that both doors 110*a*, 110*b* would perform skimming.

Also shown in FIG. 3, the fins 111*a*, 111*b* are shown in positions cooperating with each other. More specifically, with the first weir door 110*a* in a higher, or closed, position and the second weir door 110*b* in a lower, or open, position, fins 111*a*, 111*b* cooperate with each other to effectively block the space or pathway that would be present between the weir doors 110*a*, 110*b* in the absence of the fins 111*a*, 111*b*. This prevents or reduces water flow between the sides of the weir doors 110*a*, 110*b*. Fins 111*a*, 111*b* preferably are of such a size (width or height) such that at any given combination of water flow and water level, there is no space or opening or fluid pathway between the cooperating edges of the fins 111*a*, 111*b*, as shown in FIG. 3.

Figure 4B:
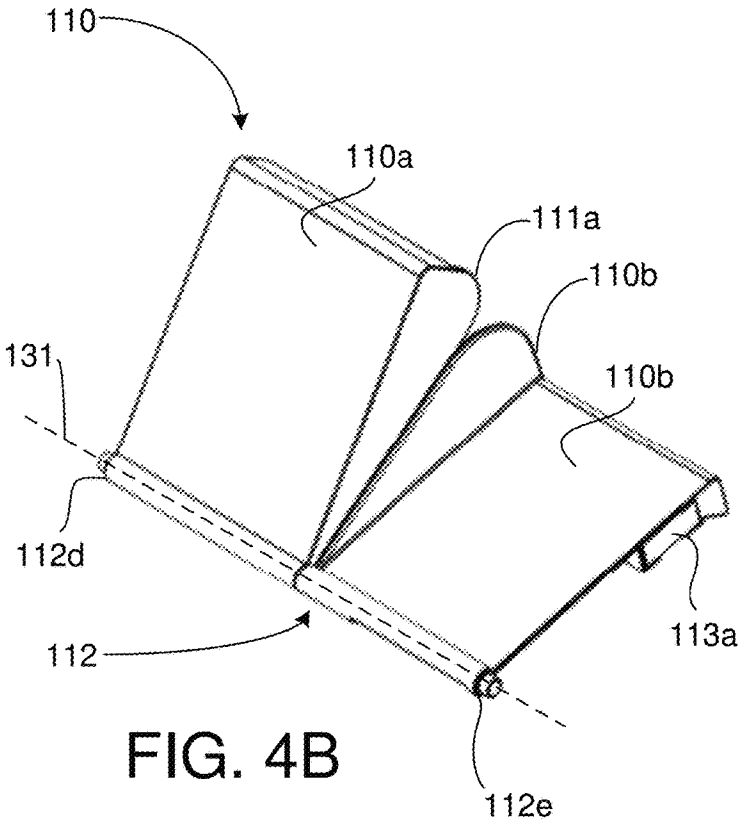
FIG. 4B illustrates a front perspective view of the dual weir door assembly illustrated in FIGS. 1-3.
Figure 4A:
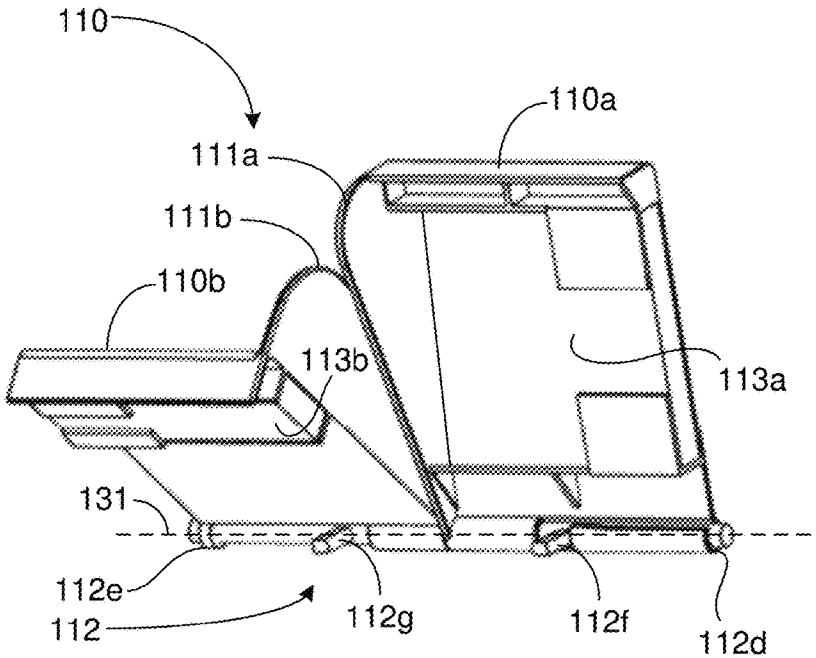
FIG. 4A illustrates a rear perspective view of the dual weir door assembly illustrated in FIGS. 1-3.

FIGS. 4A and 4B illustrate rear and front perspective views, respectively, of the dual weir doors 110*a*, 110*b* illustrated in FIGS. 1-3. In FIG. 4A, a high buoyancy device 113*a* is shown attached to the first weir door 110*a* and a low buoyancy device 113*b* is shown attached to the second weir door 110*b*. According to this exemplary embodiment, the high and low buoyancy devices 113*a* and 113*b*, respectively, are first and second foam floats, respectively, that are attached to or integrated into the first and second weir doors 110*a* and 110*b*, respectively. In accordance with this exemplary embodiment, the first foam float 113*a* has a first volume that is greater than a second volume of the second foam float 113*b* in an embodiment where the same foam is used in both foam floats 113*a*, 113*b*. Alternatively, the foam used in the higher buoyancy foam float 113*a* can be a higher buoyancy foam material than the foam material used in the lower buoyancy foam float 113*b*.

It should be noted that any materials having suitable buoyancy characteristics can be used as the high and low buoyancy devices 113*a* and 113*b*, respectively, to provide the doors 110*a* and 110*b* with the different buoyancies needed to achieve the goals of the present disclosure. Persons of skill in the art will understand how to select a suitable buoyancy material for this purpose. One of ordinary skill in the art will also recognize, in view of the present disclosure, that other buoyancy mechanisms/means are possible and are included within the scope of this disclosure. For example, the actual material of which each weir door 110*a*, 110*b* is made can be selected and/or adjusted to make the first weir door 110*a* more buoyant than the second weir door 110*b*. That is, the density or mass of the second weir door 110*b* could be made greater than the density or mass of the first weir door 110*a*, such that the first weir door 110*a* is more buoyant in a fluid, like water, than the second weir door 110*b*.

Also shown in FIGS. 4A and 4B, both weir doors 110*a*, 110*b* share a common or single rotational axis 131. The weir doors 110*a*, 110*b* are rotationally coupled along this axis 131 by the hinge assembly 112. Alternatively, as disclosed below with reference to FIG. 5, each of the weir doors 110*a*, 110*b* can have its own rotational axis, and the rotational axes can be coaxial or non-coaxial, parallel or non-parallel.

Figure 4C:
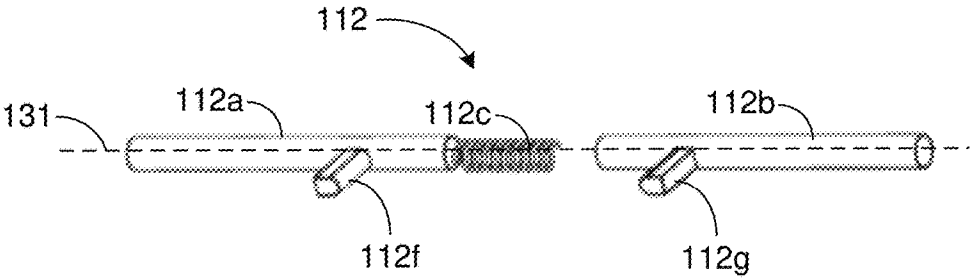
FIG. 4C illustrates a perspective view of the hinge assembly of the dual weir door assembly shown in FIGS. 1-4B in accordance with one exemplary embodiment.

FIG. 4C illustrates a perspective view of the hinge assembly 112 disassembled to show the components of the assembly 112. The hinge assembly 112, in accordance with this exemplary embodiment, comprises first and second pins 112*a* and 112*b*, respectively, a spring 112*c*, a first knuckle 112*d* (FIGS. 4A and 4B) formed in a bottom side of the first door 110*a* and a second knuckle 112*e* (FIGS. 4A and 4B) formed in a bottom side of the second door 110*b*.

The pins 112*a* and 112*b* are substantially cylindrical in shape and are typically made of a strong, durable, solid material that is rust-resistant, such as stainless steel, aluminum or hard plastic, for example. In this embodiment, the pins 112*a* and 112*b* are of the same size and shape, as depicted in FIG. 4C, but in other embodiments in which the doors 110*a*, 110*b* are of different sizes, the pins 112*a*, 112*b* can be of different sizes. The knuckles 112*d*, 112*e* are generally hollow tubes having inner surfaces that are complementary in shape and size to the outer surfaces of the pins 112*a*, 112*b*. The knuckles 112*d*, 112*e* can be made of the same material as the pins 112*a*, 112*b*. The pins 112*a* and 112*b* extend through the hollow tubes of the knuckles 112*d* and 112*e*, respectively.

As best seen in FIG. 4A, length-wise portions of the knuckles 112*d*, 112*e* are open to allow protrusions 112*f* and 112*g* of the pins 112*a* and 112*b*, respectively, to extend through the knuckles 112*d* and 112*e*, respectively, in directions generally perpendicular to the axes of the pins 112*a*, 112*b* and in directions away from the entrance to which the faceplate 102 (FIG. 1) attaches. The axes of the pins 112*a*, 112*b* and knuckles 112*d*, 112*e* are coaxial with one another and with the axis 131 of the hinge assembly 112. The protrusions 112*f*, 112*g* can serve as thumb tabs for use in installing the weir door assembly 110. These thumb tabs 112*f*, 112*g* provide a means for releasing the pins 112*a*, 112*b* from the retainer holes in the skimmer housing 101 by pressing the 112 tabs 112*f*, 112*g* inward to install or remove the weir door assembly from the skimmer housing 101.

The spring 112*c* is a cylindrically-shaped compression spring that is slightly smaller in diameter than the diameter of the pins 112*a*, 112*b* and is positioned partially within knuckle 112*d* and partially within knuckle 112*e* at the joint where the knuckles 112*d*, 112*e* meet. The spring 112*c* biases the pins 112*a*, 112*b* outwardly in their axial directions to ensure that the outer ends of the pins 112*a*, 112*b* remain seated in respective holes (not shown) that are formed in the skimmer body 101 on opposite sides of the entrance to the skimming system 100. The spring 112*c* allows some play, or movement, of the pins 112*a*, 112*b* in the axial directions 131 to allow the doors 110*a*, 110*b* to hinge, or rotate, independent of one another in response to variations in water flow velocity.

Other hinge assembly designs are contemplated and are within the scope of the invention as the hinge assembly and its design are not critical features of the invention. For example, the configuration of the hinge assembly 112 could be such that a single pin having the same diameter as pins 112*a*, 112*b*, but a length approximately equal to the combined lengths of the pins 112*a*, 112*b*, extends through the knuckles 112*d*, 112*e* with opposite ends of the pin being received in respective holes or openings formed in the front entrance walls of the skimmer body 101. As another example, the hinge assembly could include tabs molded into the doors 110*a*, 110*b* and extending from the door that can flex with a cylindrical peg to mate with the skimmer wall. As another example, the hinge assembly can comprise static pegs on the doors and a hinge bracket attached to the skimmer wall to retain the peg. As will be understood by those of skill in the art, many known or common hinge types and designs are suitable for use with the present invention.

Figure 5:
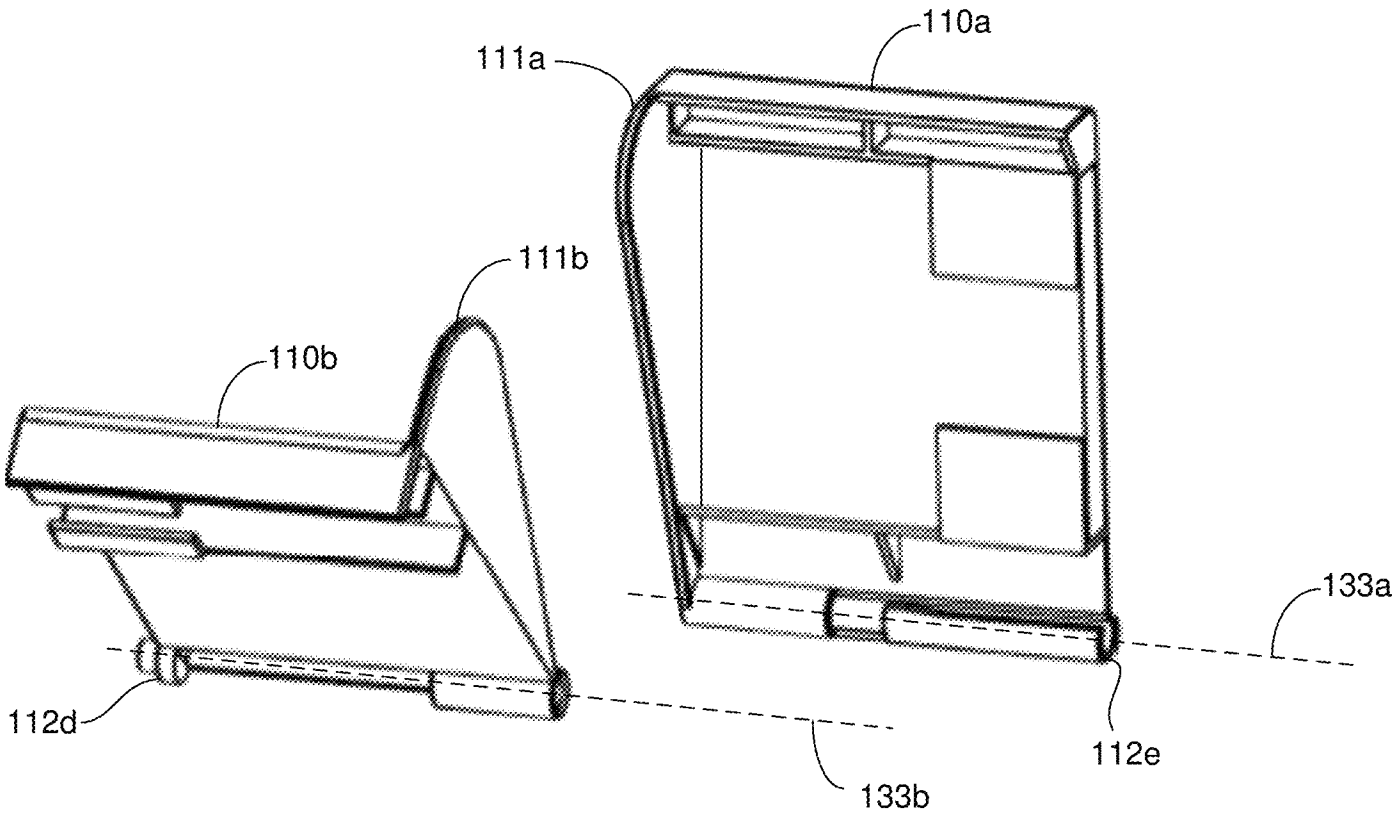
FIG. 5 illustrates a rear perspective view of the two weir doors shown in FIGS. 1-4B in accordance with another exemplary embodiment in which the doors are configured to rotate about different axes.

FIG. 5 illustrates a rear perspective view of the two weir doors 110*a*, 110*b* in accordance with another exemplary embodiment in which each weir door 110*a* and 110*b* rotates on its own rotational axis 133*a* and 133*b*, respectively. In FIG. 5, a hinge assembly is not shown for ease of illustration, but it could be similar to the hinge assembly 112 or any of the aforementioned alternative hinge assembly designs. For example, pins 112*a* and 112*b* could be passed through the knuckles 112*d* and 112*e*, respectively, with both the ends of both of the pins 112*a*, 112*b* being seated in respective openings formed in a wall or surface of the skimmer body 101. In such an embodiment, one or both of the fins 111*a*, 111*b* can be adjusted in size and/or shape to have greater surface area to cover a larger gap that would exist between the two weir doors 110*a*, 110*b* due to the separate rotational axes 133*a*, 133*b*.

Figure 6B:
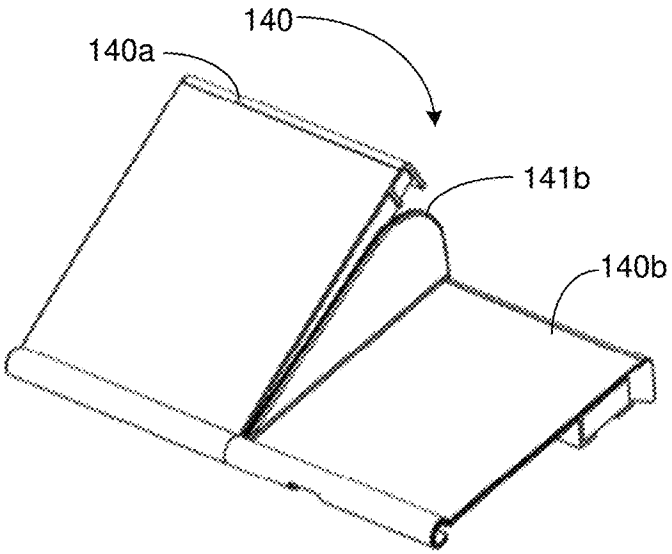
FIG. 6B illustrates a front perspective view of the dual weir door assembly shown in FIG. 6A.
Figure 6A:
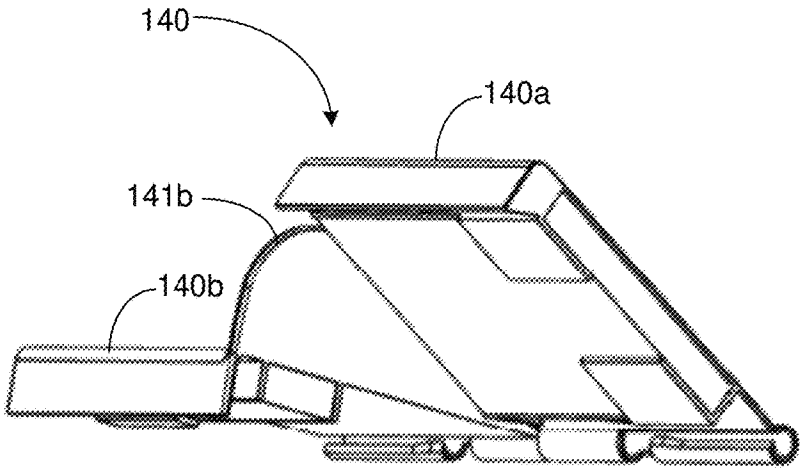
FIG. 6A illustrates a rear perspective view of a dual weir door assembly of a skimming system in accordance with another exemplary embodiment in which one of the weir doors is finless and the other weir door includes a fin.
Figure 6C:
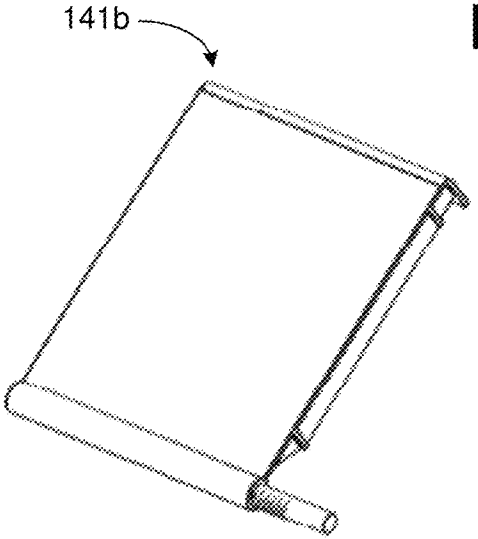
FIG. 6C illustrates a front perspective view of the finless weir door illustrated in FIGS. 6A and 6B.

FIGS. 6A and 6B illustrate rear and front perspective views, respectively, of a dual weir door assembly 140 in accordance with another exemplary embodiment. According to this exemplary embodiment, the first weir door 140*a* has a higher buoyancy than that of the second weir door 140*b*, but does not have a fin similar to the fin 111*a* shown in FIG. 4B. In other words, the door 140*a* is finless. FIG. 6C illustrates a side perspective view of the first weir door 140*a* illustrated in FIGS. 6A and 6B illustrating the finless configuration of the door 140*a*. The second weir door 140*b* does have a fin 141*b* similar to the fin 111*b* shown in FIG. 4B, but the fin 141*b* is larger at the bottom than fin 111*b* to block the larger gap that exists between the doors 140*a*, 140*b* when the angle of rotation between the doors 140*a*, 140*b* is large. The fin 141*b* may be adjusted in size and/or shape, such as being increased to be greater in height than fin 111*b* illustrated in FIG. 4B in the upward direction parallel to the axis of rotation of the hinge assembly. The hinge assembly that is used for the dual weir door assembly 140 can be the same as the hinge assembly 112 discussed above with reference to FIGS. 4A-4C. In the positions of the doors 140*a*, 140*b* shown in FIGS. 6A and 6B, the finless door 140*a* is substantially closed to the flow of water and the door 140*b* is substantially open to the flow of water. It can be seen that in these positions, the fin 141*b* substantially covers the opening that would otherwise exist between the doors 140*a*, 140*b*.

In other exemplary embodiments, the first weir door 140*a* can have a fin similar in shape and size to fin 141*b*, while the second weir door 140*b* does not have a fin.

Figure 7:
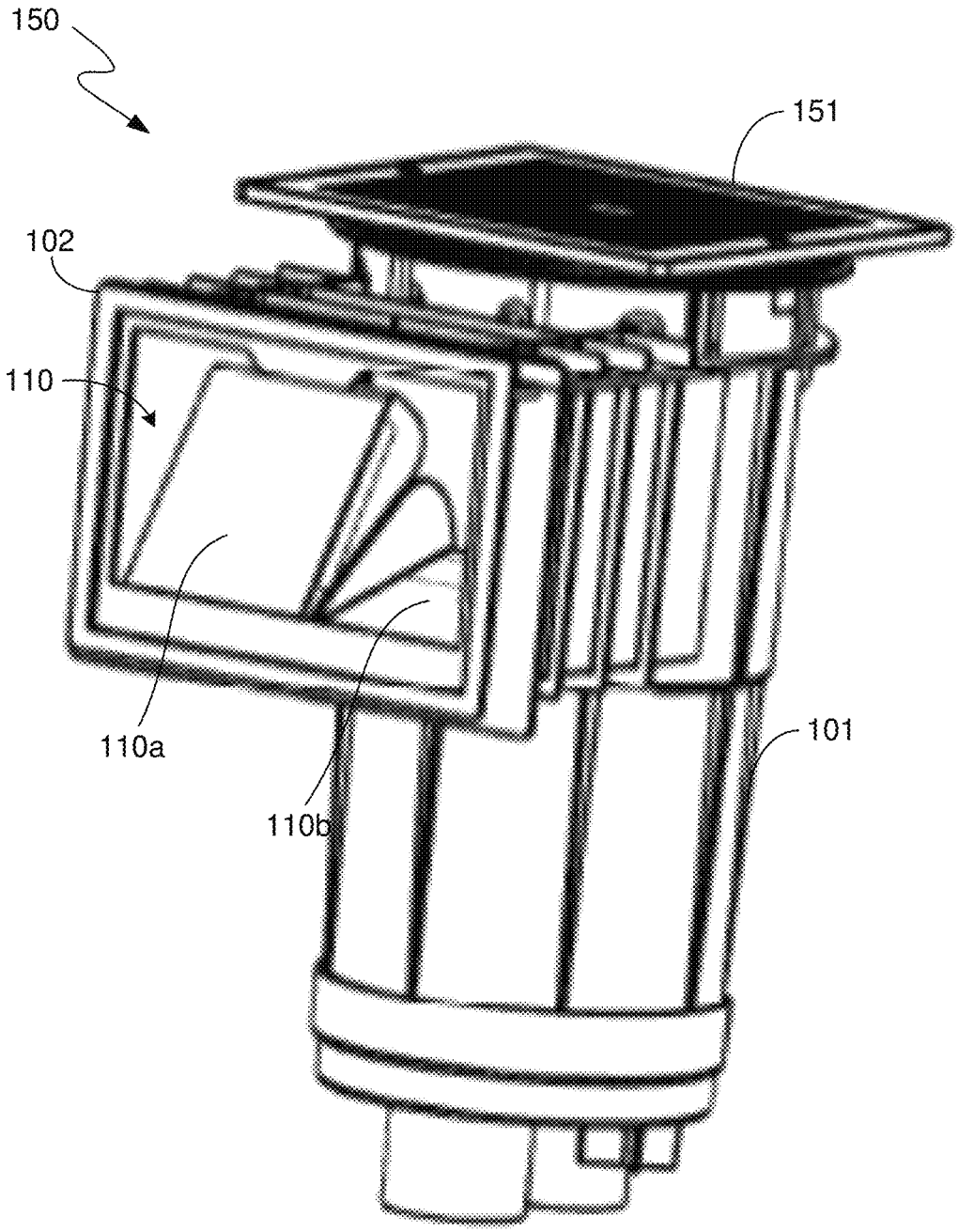
FIG. 7 illustrates a front perspective view of a skimming system in accordance with another exemplary embodiment that incorporates the dual weir door assembly shown in FIGS. 1-4B and has a square lid.

FIG. 7 illustrates a front perspective view of a skimming system 150 in accordance with another exemplary embodiment that incorporates the dual weir door assembly 110 shown in FIGS. 1-4B. In accordance with this exemplary embodiment, the skimming system 150 has a square lid 151, in contrast the round lid 108 of the skimming system 100 shown in FIG. 1. In all other respects, the skimming system 150 can be identical to the skimming system 100 shown in FIGS. 1-4B.

It should be noted that although the skimming system 150 is shown in FIG. 7 as including the dual weir door assembly 110 shown in FIGS. 1-4B, it could instead include any multi-weir door assembly, including, but not limited to the dual weir door assemblies discussed above with reference to FIGS. 5-6C. Likewise, although the skimming system 100 is shown in FIG. 1 has been discussed and shown as including the dual weir door assembly 110 shown in FIGS. 1-4B, it could instead include any multi-weir door assembly, including, but not limited to the dual weir door assemblies discussed above with reference to FIGS. 5-6C.

Figure 8A:
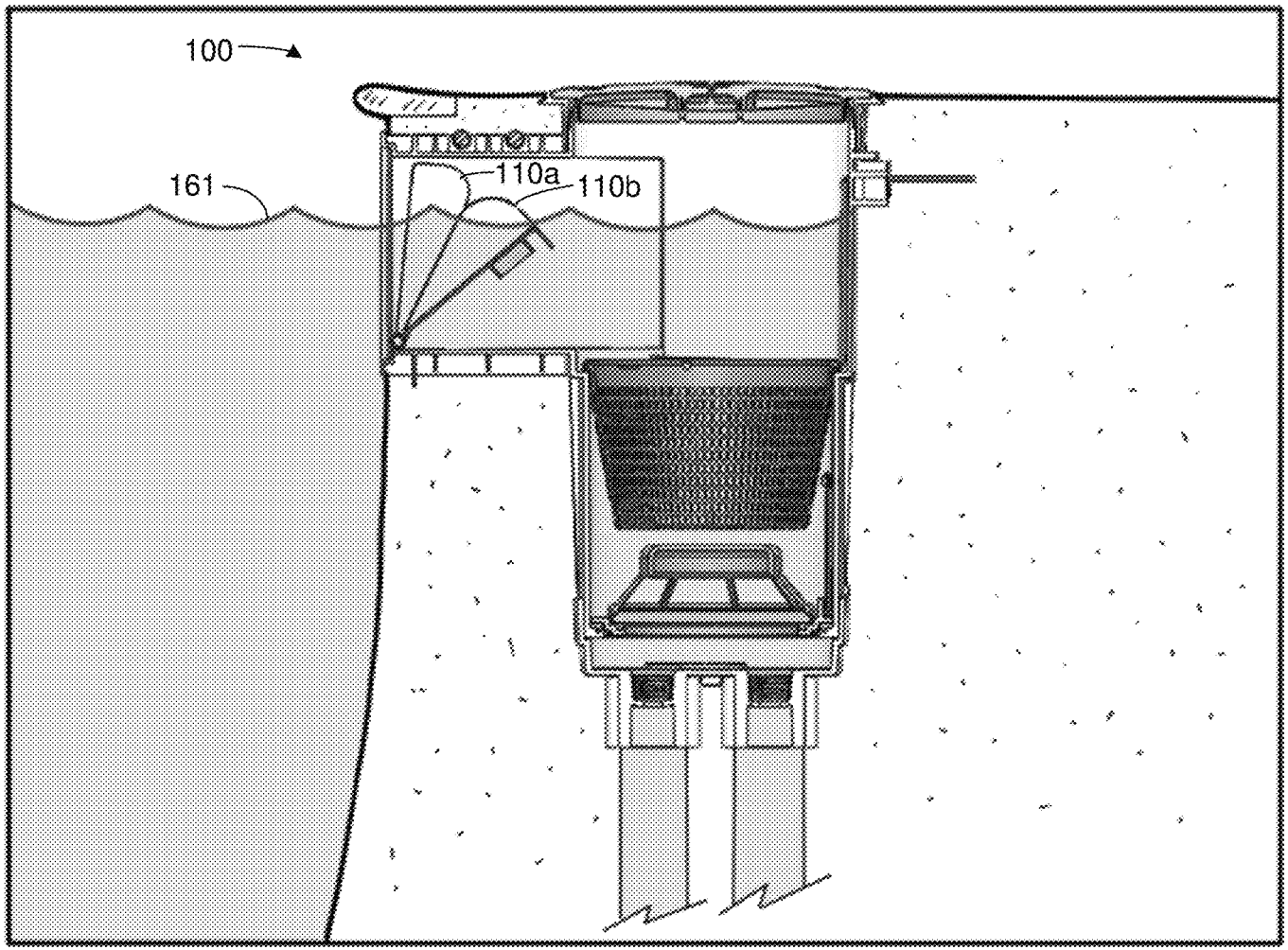
FIGS. 8A-8C generally illustrate the water levels in a typical pool showing the respective heights of each of the weir doors of the dual weir door assembly shown in FIGS. 1-4B during various water flow velocities.
Figure 8B:
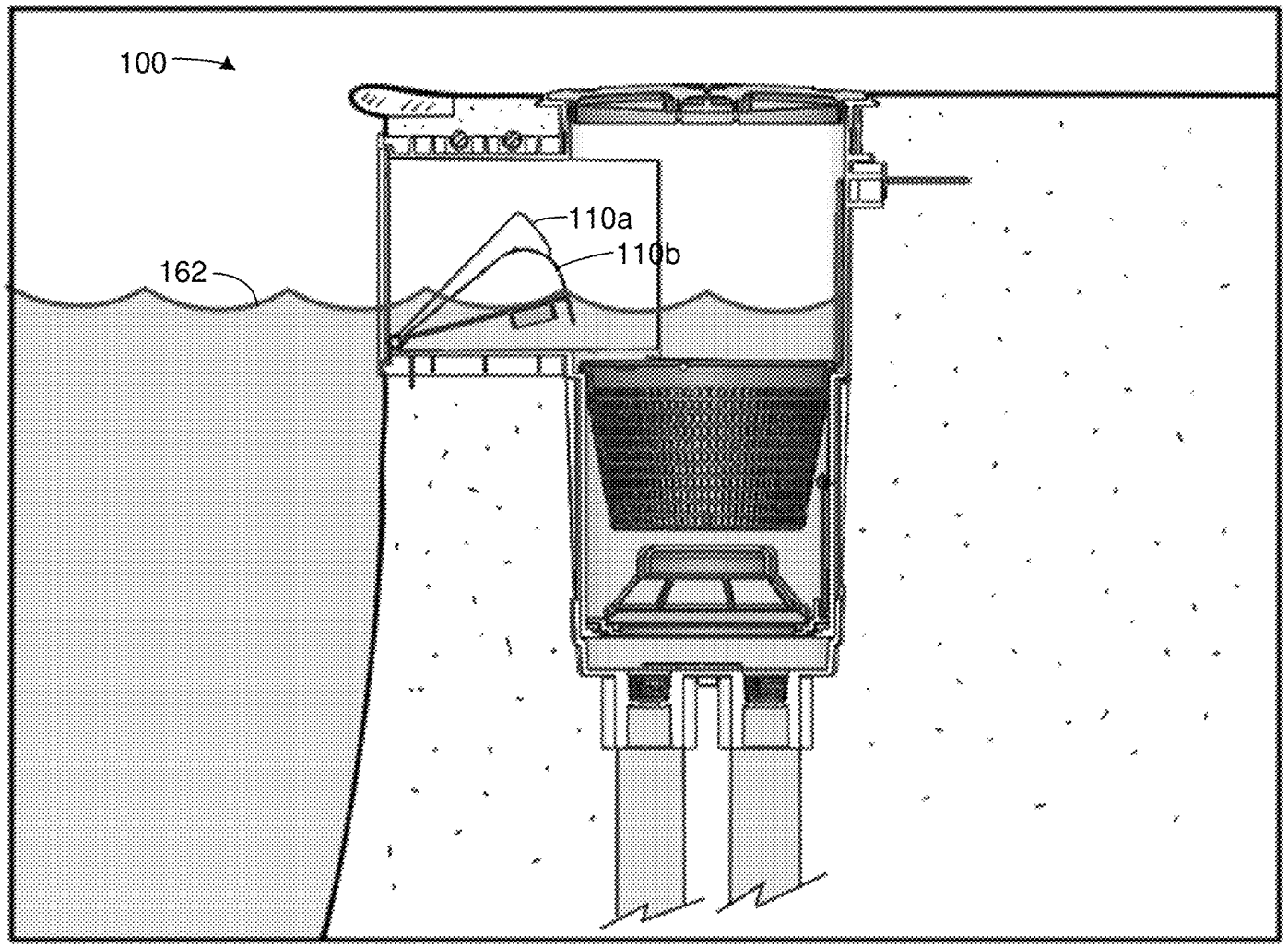
Figure 8C:
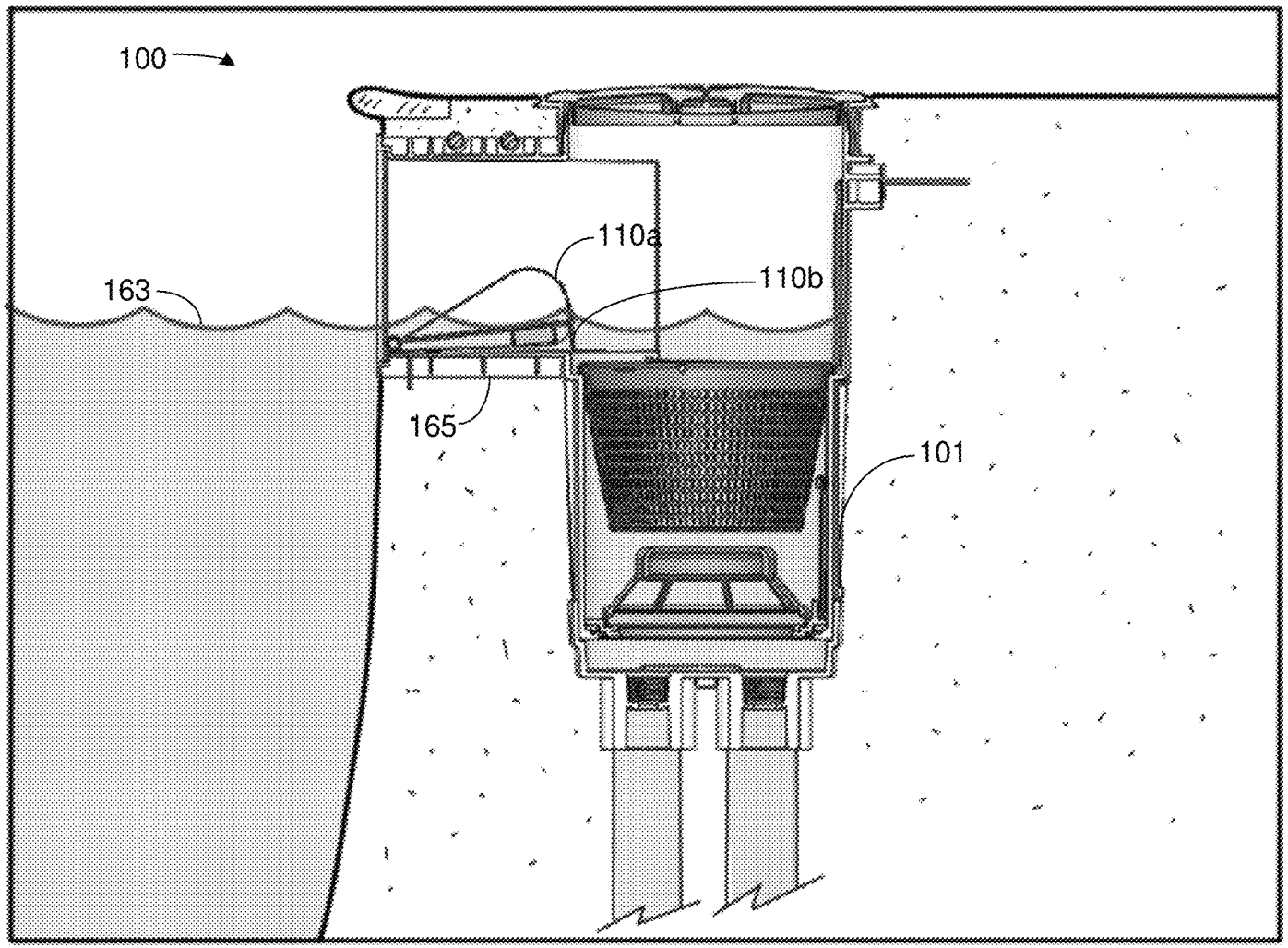

FIGS. 8A-C illustrate side views of a pool equipped with the skimming system 100 shown in FIG. 1 for three different water levels 161-163, respectively, in a typical pool and show the corresponding positions of the weir doors 110*a*, 110*b* during the corresponding water flows of different velocities. Specifically, FIG. 8A shows a high water level 161 of a corresponding low velocity flow with the first weir door 110*a* closed to the flow of water and the second weir door 110*b* open to the flow of water to perform skimming. With a low velocity water flow, or at least a lower velocity water flow, through the recirculating system (e.g., pump, filter, chlorinator, etc.), the water flow does not affect the higher buoyancy first weir door 110*a* as much as it affects the lower buoyancy second weir door 110*b* consequently, the higher buoyancy first weir door 110*a* remains in the closed position. This causes substantially all of the water flow to flow over the reduced width of the water flow path provided by the open second weir door 110*b*, thus increasing the efficiency of the skimming system 100 during low water flow conditions.

FIG. 8B shows a medium water level 162 with a medium velocity flow with the first weir door 110*a* mostly open and the second weir door 110*b* partially open. With a medium velocity flow of the pool water through the recirculating system (e.g., pump, filter, chlorinator, etc.), the medium velocity water flow can affect the higher buoyancy first weir door 110*a*, but not as much as it affects the lower buoyancy second weir door 110*b*. This allows the doors 110*a*, 110*b* to open and close depending on the actual flow rate. This causes all of the water flow to pass over the reduced width of the water flow path provided by only the second weir door 110*b* being open during an ebb in the medium flow rate and causes the water to flow over the wider water flow path provided by both doors 110*a*, 110*b* being open during an increase in the medium flow rate. The result is an increase in skimming efficiency during medium water flow conditions.

FIG. 8C shows a low water level 163 and a corresponding high velocity flow with both the first and the second weir doors 110*a*, 110*b* being open. With a high velocity flow of the pool water through the recirculating system (pump, filter, chlorinator, etc.), the water flow affects both the lower buoyancy second weir door 110*b* and the higher buoyancy first weir door 110*a*, placing them both in the maximum open positions. In this maximum open position of both doors 110*a*, 110*b*, the water flows over the wider water flow path corresponding to the combined widths of both weir doors 110*a*, 110*b*, thus increasing the efficiency of the skimming system 100 during high water flow conditions.

When the pump is on, the suction it creates pulls floating debris over the weir doors 110*a*, 110*b* when they are open and into the skimming system 100 where it is collected in a skimmer basket for removal from the pool. When the pump is off, the closed weir doors 110*a*, 110*b* prevent this debris from floating back into the pool. With no pump flow, the buoyancy of the weir doors 110*a*, 110*b* causes them to float to their closed positions at which portions of both doors protrude above the water line to prevent any floating debris inside of the skimming system 100 from floating back out into the pool.

The skimming systems and methods described herein may be used on almost any artificial water body. While the skimming systems and methods are described herein in connection with a pool and spa, it is understood that the skimming systems and methods may be used on spas, swimming pools, tubs, Jacuzzis, and the like. One of ordinary skill in the art will understand the manner in which the skimming systems 100 and 150 can be modified without undue experimentation so that they can be used on virtually any artificial water body to achieve efficient skimming of an artificial body of water that uses a pump system that pumps at multiple speeds.

It should also be noted that although the skimming system has been described as being configured to operate effectively with pumps that can operate at variable speeds, the skimming system can also be used effectively with a pump that operates at a single set speed. It should also be noted that although the multi-weir door assembly has been described as a dual weir door assembly, the assembly can have any number, N, of weir doors, where N is a positive integer that is greater than or equal to 2.

The various components of the skimming system can be manufactured from relatively inexpensive materials. Appropriate components are molded or formed from a plastic material that will not corrode or be adversely affected from the exposure to water, particularly chlorinated water, and other chemicals present in a spa setting. Other appropriate components can be formed from materials such as steel, aluminum, other metals, rock, acrylic, fiberglass, etc., as aesthetically or structurally needed or desired. Such materials are known to one of ordinary skill in the art.

The foregoing detailed description of the exemplary embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

While detailed descriptions of the preferred embodiments are provided herein, as well as the best mode of carrying out and employing the present invention, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

What is claimed is:

1. A skimming system for skimming an artificial body of water, the system comprising:

a skimmer body configured to be installed in the artificial body of water, the skimmer body having a front entrance for receiving a flow of water of the artificial body of water into an interior of the skimmer body; and a multi-weir door assembly mechanically coupled to the skimmer body near the front entrance such that the flow of water received in the front entrance is incident on a front side of the multi-weir door assembly, the multi-weir door assembly comprising multiple weir doors that are rotationally coupled to the skimmer body by at least a first hinge assembly, each of the weir doors having a respective buoyancy, and wherein at least first and second weir doors of said multiple weir doors have first and second buoyancies that are different from one another such that the flow of water incident on the multi-weir door assembly affects the first and second weir doors differently in terms of an angular degree to which the incident flow of water causes the first and second weir doors to rotate about first and second axes of rotation, respectively.

2. The skimming system of claim 1, wherein the multi-weir door assembly is a dual weir door assembly having no weir doors other than the first and second weir doors.

3. The skimming system of claim 2, wherein the first and second axes of rotation are coaxial with one another and with an axis of said at least a first hinge assembly such that the first and second axes of rotation and the axis of said at least a first hinge assembly correspond to a common axis of rotation of the first and second weir doors.

4. The skimming system of claim 3, wherein the first and second buoyancies of the first and second weir doors are created, at least in part, by first and second buoyancy devices, respectively, that are attached to or integrated into the first and second weir doors, respectively.

5. The skimming system of claim 4, wherein the first and second buoyancy devices are high and low buoyancy devices, respectively, such that the flow of water incident on the multi-weir door assembly causes the angular degree to which the second weir door rotates about the common axis of rotation to be greater than the angular degree to which the first weir door rotates about the common axis of rotation.

6. The skimming system of claim 5, wherein if the flow of water incident on the dual weir door assembly has a relatively low flow velocity, the angular degree to which the second weir door rotates about the common axis of rotation places the second weir door in an open position in which the second weir door performs skimming whereas the angular degree to which the first weir door rotates is causes the first weir door to remain in a closed position in which the first weir door does not perform skimming.

7. The skimming system of claim 6, wherein if the flow of water incident on the dual weir door assembly has a relatively high flow velocity, the angular degree to which the second weir door rotates about the common axis of rotation places the first and second weir doors in open positions in which the first and second weir doors both perform skimming.

8. The skimming system of claim 7, wherein if the flow of water incident on the dual weir door assembly has a medium flow velocity that is greater than said relatively low flow velocity and less than said relatively high flow velocity, the angular degrees to which the first and second weir doors rotate about the common axis of rotation depend on whether there is an ebb in the medium flow velocity or an increase in the medium flow velocity, wherein an ebb in the medium flow velocity causes the second weir door to rotate about the common axis of rotation to an angular degree that places the second weir door in an open position in which the second weir door performs skimming and causes the angular degree to which the first weir door rotates about the common axis of rotation to cause the first weir door to remain in a closed position in which the first weir door does not perform skimming, wherein an increase in the medium flow velocity causes the first and second weir doors to rotate about the common axis of rotation to respective angular degrees that place the first and second weir doors in open positions in which the first and second weir doors perform skimming.

9. The skimming system of claim 5, wherein the first and second buoyancy devices are first and second foam floats, respectively, of high and low buoyancy, respectively, the first and second foam floats being made of a same floatation material, the first foam float comprising a greater volume of foam floatation material than the second foam float.

10. The skimming system of claim 5, wherein the first and second buoyancy devices are first and second foam floats, respectively, of high and low buoyancy, respectively, the first foam float being made of a foam material having a higher buoyancy than a buoyancy of a foam material of which the second foam float is made.

11. The skimming system of claim 1, wherein the first and second axes of rotation are non-coaxial.

12. The skimming system of claim 3, wherein the first weir door has a first fin disposed thereon and the second weir door has a second fin disposed thereon, the first and second fins being adjacent one another, and wherein if the flow of water incident on the multi-weir door assembly is sufficient to cause the second weir door to rotate about the common axis of rotation to an open position, but is insufficient to cause the first weir door to rotate about the common axis of rotation to an open position, the first and second fins cooperate to substantially confine the flow of water to a flow path that passes over the second weir door.

13. The skimming system of claim 1, wherein the first and second weir doors are laterally offset from one another relative to a direction of the flow of water received at the front entrance.

14. A method for skimming an artificial body of water, the method comprising:

receiving a flow of water of the artificial body of water into an interior of a skimmer body of a skimming system through a front entrance of the skimmer body, wherein the skimmer body is installed in the artificial body of water and the multi-weir door assembly is mechanically coupled to the skimmer body near the front entrance such that the flow of water received in the front entrance is incident on a front side of the multi-weir door assembly; and performing skimming with the multi-weir door assembly, the multi-weir door assembly comprising multiple weir doors that are rotationally coupled to the skimmer body by at least a first hinge assembly, each of the weir doors having a respective buoyancy, and wherein at least first and second weir doors of said multiple weir doors have first and second buoyancies that are different from one another such that the flow of water incident on the multi-weir door assembly affects the first and second weir doors differently in terms of an angular degree to which the incident flow of water causes the first and second weir doors to rotate about first and second axes of rotation, respectively.

15. The method of claim 14, wherein the multi-weir door assembly is a dual weir door assembly having no weir doors other than the first and second weir doors.

16. The skimming system of claim 15, wherein the first and second axes of rotation are coaxial with one another and with an axis of said at least a first hinge assembly such that the first and second axes of rotation and the axis of said at least a first hinge assembly correspond to a common axis of rotation of the first and second weir doors.

17. The method of claim 16, wherein the first and second buoyancy devices are high and low buoyancy devices, respectively, such that the flow of water incident on the multi-weir door assembly causes the angular degree to which the second weir door rotates about the common axis of rotation to be greater than the angular degree to which the first weir door rotates about the common axis of rotation.

18. The method of claim 17, wherein if the flow of water incident on the dual weir door assembly has a relatively low flow velocity, the angular degree to which the second weir door rotates about the common axis of rotation places the second weir door in an open position in which the second weir door performs skimming whereas the angular degree to which the first weir door rotates is causes the first weir door to remain in a closed position in which the first weir door does not perform skimming.

19. The method of claim 18, wherein if the flow of water incident on the dual weir door assembly has a relatively high flow velocity, the angular degree to which the second weir door rotates about the common axis of rotation places the first and second weir doors in open positions in which the first and second weir doors both perform skimming.

20. The method of claim 19, wherein if the flow of water incident on the dual weir door assembly has a medium flow velocity that is greater than said relatively low flow velocity and less than said relatively high flow velocity, the angular degrees to which the first and second weir doors rotate about the common axis of rotation depend on whether there is an ebb in the medium flow velocity or an increase in the medium flow velocity, wherein an ebb in the medium flow velocity causes the second weir door to rotate about the common axis of rotation to an angular degree that places the second weir door in an open position in which the second weir door performs skimming and causes the angular degree to which the first weir door rotates about the common axis of rotation to cause the first weir door to remain in a closed position in which the first weir door does not perform skimming, wherein an increase in the medium flow velocity causes the first and second weir doors to rotate about the common axis of rotation to respective angular degrees that place the first and second weir doors in open positions in which the first and second weir doors perform skimming.

* * * * *